US006302180B1

(12) United States Patent
Yu

(10) Patent No.: US 6,302,180 B1
(45) Date of Patent: Oct. 16, 2001

(54) RETAINING DEVICE FOR DECORATION ARTICLES ATTACHED TO ENDS OF SUSPENSION ROD OF VENETIAN BLIND

(75) Inventor: Sandy Yu, Changhua (TW)

(73) Assignee: Piing Heh Enterprise Co., Ltd., CHanghua (TW)

( * ) Notice: Subject to any disclaimer, the term of this patent is extended or adjusted under 35 U.S.C. 154(b) by 0 days.

(21) Appl. No.: 09/726,322

(22) Filed: Dec. 1, 2000

(51) Int. Cl.[7] ..... A47H 1/00
(52) U.S. Cl. ..... 160/38; 160/330; 160/178.1 R
(58) Field of Search ..... 160/330, 38, 39, 160/123, 124, 126, 84.01, 178.1 R, 178.1 V, 349.1; 211/105.1; 16/87 R, 87.2

(56) References Cited

U.S. PATENT DOCUMENTS 3,693,210 * 9/1972 MacFarlane et al. ..... 160/330
4,085,480 * 4/1978 Kromm et al. ..... 160/38 X
5,615,721 * 4/1997 Winter ..... 160/38
5,642,595 * 7/1997 Daniels et al. ..... 160/330 X
5,670,221 * 9/1997 Bried et al. ..... 160/314 X
6,112,801 * 9/2000 Daniels et al. ..... 160/330

* cited by examiner

*Primary Examiner*—David M. Purol
(74) *Attorney, Agent, or Firm*—Bacon & Thomas

(57) ABSTRACT

A retaining device for decoration articles secured to the ends of the suspension rod of a Venetian blind is provided. One end of each decoration article is provided with a cylindrical receiving cavity of a proper depth. The receiving cavity is defined in a tapered manner with its diameter gradually decreased inwardly to form an abutment wall for use in a suspension rod of a larger diameter which can be inserted into the decoration article and firmly held in place. At the bottom of the cavity is disposed an axially extended retaining post which has a plurality of radially protruded retaining plates. The front end of each retaining plate is provided with a smoothly arched edge and each retaining plate is gradually tapered with its height gradually increased inwardly. The retaining post is adapted for holding a suspension rod of smaller diameter which is inserted into the decoration article with the tapered retaining plates each having smoothly arched front edge of the retaining post in firm abutment with the inner surface of the suspension rod.

1 Claim, 3 Drawing Sheets

RETAINING DEVICE FOR DECORATION ARTICLES ATTACHED TO ENDS OF SUSPENSION ROD OF VENETIAN BLIND

BACKGROUND OF THE INVENTION

The present invention relates to a retaining device for decoration articles that are secured to the ends of the suspension rod of a Venetian blind. One end of each decoration article is provided with a cylindrical cavity of a proper depth. The cavity is defined in a tapered manner with its diameter gradually decreased inwardly to form an abutment surface for use in a suspension rod of a larger diameter which can be inserted into the decoration article and firmly held in place. At the bottom of the cavity is disposed an axially extended retaining post which has a plurality of radially protruded retaining plates. The front end of each retaining plate is provided with a smoothly arched edge and each retaining plate is gradually tapered with its height gradually increased inwardly. The retaining post is adapted for holding a suspension rod of smaller diameter which is inserted into the decoration article with the tapered retaining plates having smoothly arched edge of the retaining post in firm abutment with the inner surface of the suspension rod.

Generally, a suspension rod of a household Venetian blind mounted to a window or door is equipped with a decoration article at respective ends. There are two types of prior retaining device for such decoration articles.

Referring to FIG. 1, the first prior art includes a suspension rod 10, a pair of decoration articles 20 and two screws 30. The suspension rod 10 is a cylindrical hollow tube. Each decoration article 20 has one receiving cavity 21 of a proper depth engageable with each end of the suspension rod 10. The receiving cavity 21 has a slightly larger diameter than that of each end of the cylindrical hollow suspension rod 10. On the wall of the receiving cavity 21 is provided with a screw hole 22. At the other end of the decoration article 20 is disposed a decorator 23. In assembly, each decoration article 20 is engaged with one end of the suspension rod 10 with its receiving cavity 21 firmly and integrally secured in place by a screw 30 led through the screw hole 22 of each decoration article 20.

Such a prior art has the following disadvantages:

1. The decoration articles 20 must be fixed in place to the suspension rod 10 by the screw 30 led through the screw hole 22. It must be secured in place with a tool and the decoration articles can not be easily replaced.
2. The decoration articles are secured in place by screws 30 which can cause deformation on the suspension rod 10 as a result of locking forces.
3. The decoration articles 20 are only limitedly applied to one size of the suspension rod 10.

Referring to FIG. 2, another prior art is made up of the suspension rod 10, and a pair of decoration articles 40 each having a receiving cavity 41. The receiving cavity 41 has a tapered form with its diameter inwardly reduced so as to form a conical abutting surface 42. The decoration articles 40 having a decorator 43 at the other end are respectively locked to the ends of the suspension rod 10 with the articles 40 turned into tight engagement therewith, as a result of the tapered surface 42 abutting against the outer surface of the suspension rod 10.

Such a second prior art has a disadvantage: the receiving cavity 41 of the decoration article 40 is only limitedly applied to suspension rods of one size; and many decoration articles 40 of different sizes must be provided for suspension rods 10 of various diameters.

SUMMARY OF THE INVENTION

Therefore, the primary object of the present invention is to provide a retaining device for a decoration article attached to ends of a suspension rod of a Venetian blind. It permits decoration articles easily and quickly secured to suspension rods of both large or small diameters whereby various decoration articles can be replaced with ease and speed.

DETAILED DESCRIPTION OF THE PREFERRED EMBODIMENT

Figure 1:
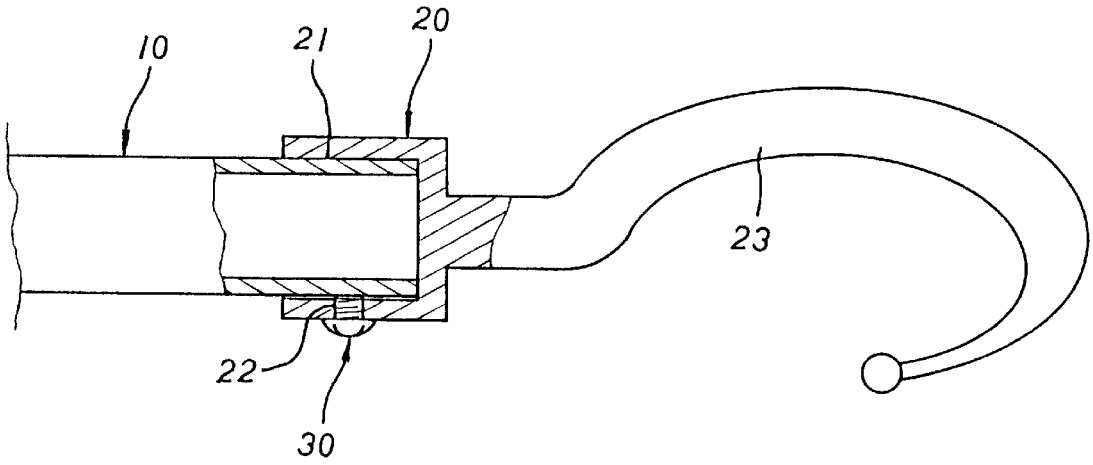
FIG.1 PRIOR ART
FIG. 1 is a sectional diagram of a first prior art.
Figure 2:
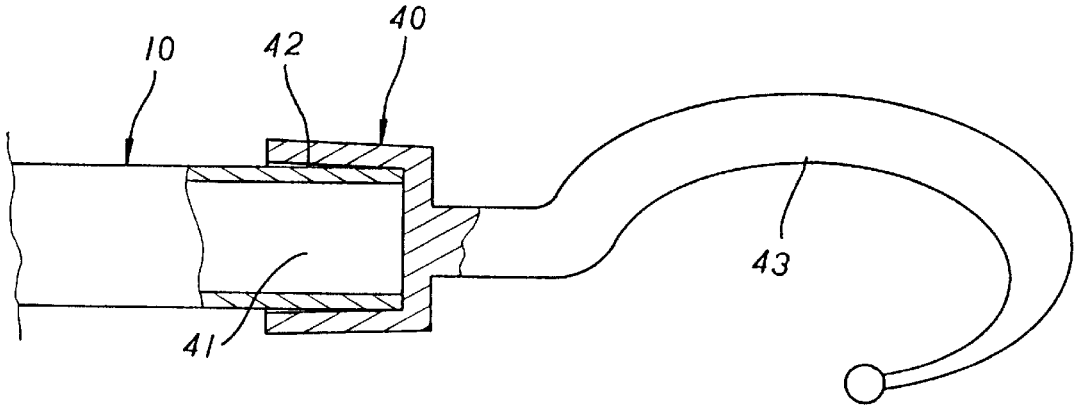
FIG.2 PRIOR ART
FIG. 2 is a sectional diagram of a second prior art.
Figure 3:
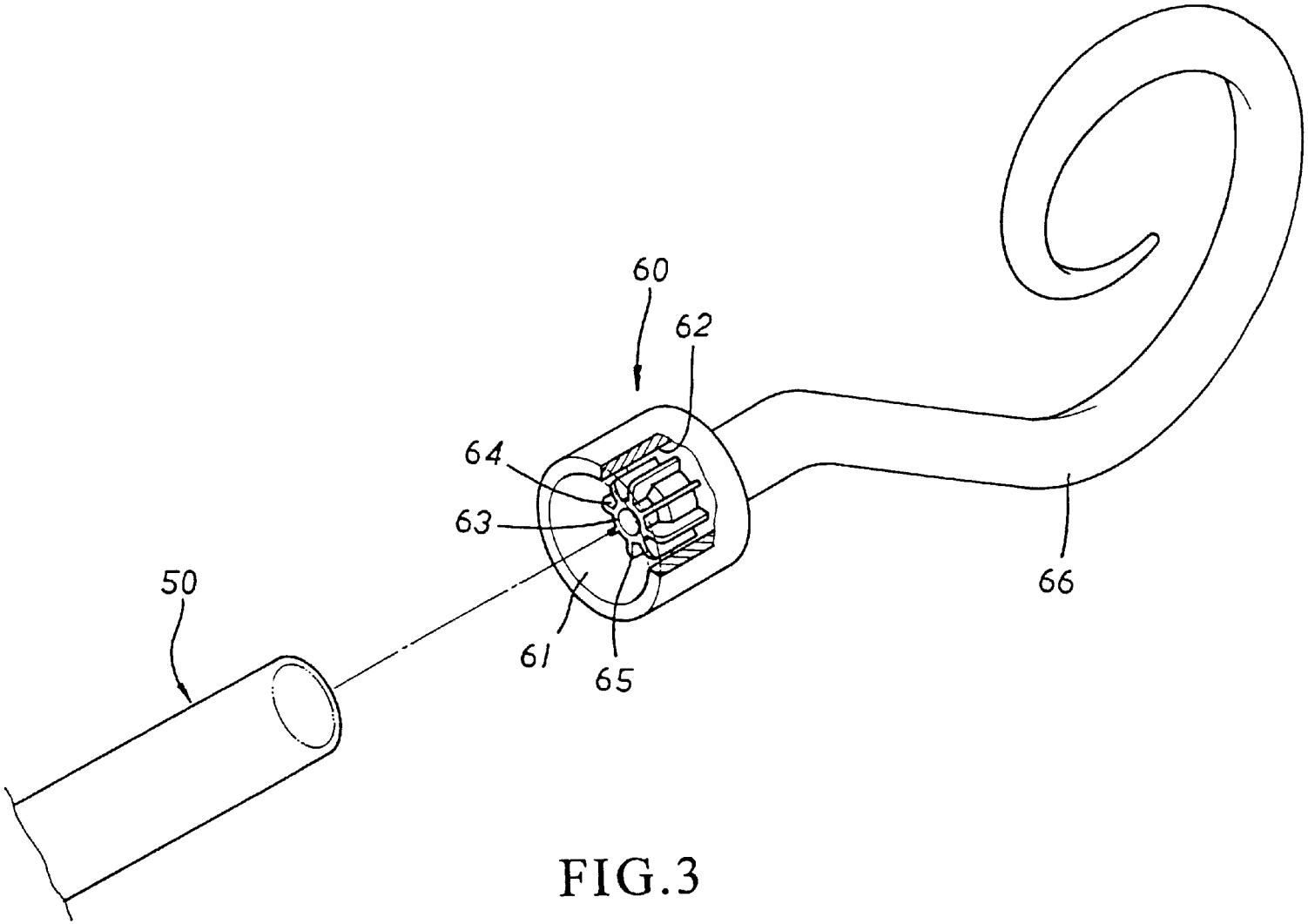
FIG. 3 is a perspective diagram showing the exploded components of the present invention.

Referring to FIG. 3, the present invention comprises a suspension rod 50 of a Venetian blind and a pair of decoration articles 60 fixed to the ends of the suspension rod 50. The suspension rod 50 is a cylindrical hollow tube. One end of each decoration article 60 is provided with a cylindrical receiving cavity 61 of a proper depth. The receiving cavity 61 is defined in a tapered manner with its diameter gradually decreased inwardly to form an abutment surface 62 for use in the suspension rod 50 of a larger diameter which can be inserted into the decoration article 60 and firmly held in place. At the bottom of the receiving cavity 61 is disposed an axially extended retaining post 63 which has a plurality of radially protruded retaining plates 64. The front end of each retaining plate 64 is provided with a smoothly arched edge and each retaining plate 64 is gradually tapered with its height gradually increased inwardly. The other end of the decoration article 60 is provided with a decorator 66 integrally formed with the decoration article 60. The retaining post 63 is adapted for holding a suspension rod 50 of smaller diameter which is inserted into the decoration article 60 with the tapered retaining plates having a smoothly arched front edge 65 of the retaining post 63 in firm abutment with the tapered inner abutment surface 62 of the suspension rod 50.

Figure 4:
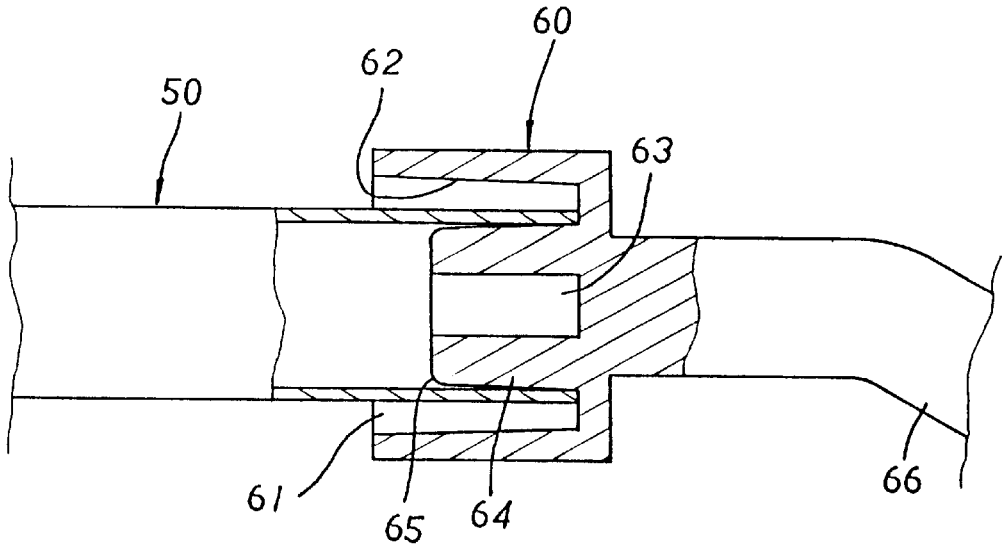
FIG. 4 is a diagram showing the present invention applied to a rod of a small diameter.

Referring to FIG. 4, the present invention can be applied to a suspension rod 50 of a smaller diameter which is easily adopted to suspend a small-sized Venetian blind to windows or doors so as to avoid use of improper size of suspension rod 50. It can prevent waste of material and save consumers' budget too. When a suspension rod 50 of a smaller size is engaged with the decoration article 60 with the smoothly arched front edge 65 moving against the inner wall of the suspension rod 50 and firmly retained in place by way of the equally spaced retaining plates 64.

Figure 5:
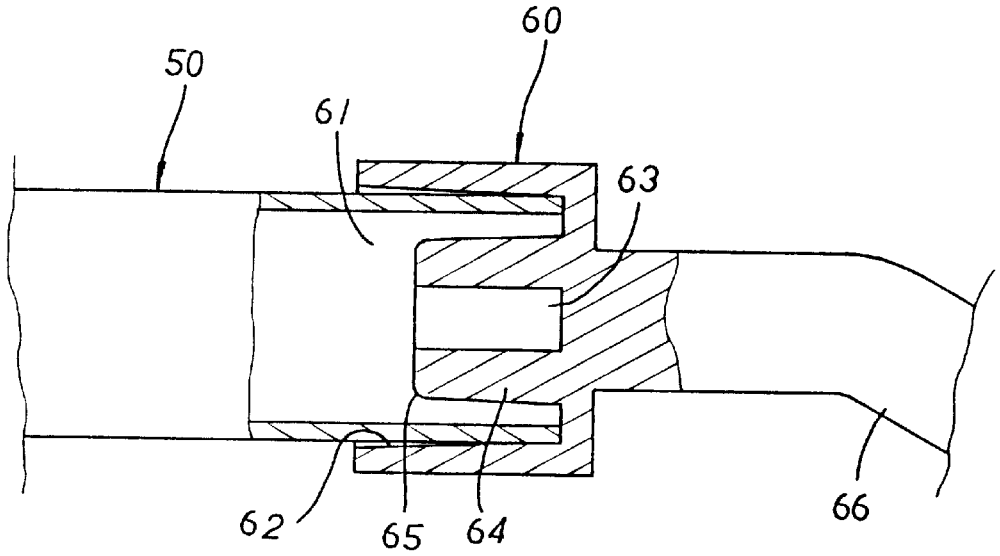
FIG. 5 is a diagram showing the present invention applied to a rod of a large diameter.

Referring to FIG. 5, the decoration articles 60 can also be applied to a suspension rod 50 of a larger diameter which is used to hold a large-sized Venetian blind. The suspension rod 50 has a stiffer structure for holding a large Venetian blind in place. As the decoration article 60 is engaged with one end of the suspension rod 50 by insertion, the tapered inner surface 62 of the receiving cavity 61 of the decoration article 60 comes into tighter abutment against the outer surface as a result of the decoration article 60 is forced inwardly into the suspension rod 50.

There is an advantage obtained in the present invention. The decoration article 60 is secured in place to a suspension rod without using a tool with ease and speed so as to make the decoration articles 60 variously replaced readily. The conically tapered abutment surface 62 of the receiving cavity 61 and the tapered retaining plates 64 enable the decoration article 60 to be engaged with suspension rods 50 of different diameters.

I claim:

1. A decorative article which comprises a retaining device for coupling said decorative article to an end portion of a hollow cylindrical tube wherein said retaining device includes a cylindrical receiving cavity for receiving said end portion of said hollow cylindrical tube therein, said receiving cavity having an inside diameter which decreases inwardly whereby said receiving cavity has a conical abutment surface therein; and said retaining device further includes a retaining post axially extending from a bottom portion of said receiving cavity;

said retaining post having a plurality of radially protruding plates, said protruding plates being tapered so that the height of each plate gradually increases inwardly, and each of said plates having a smoothly arched front edge.

* * * * *